US006398842B2

(12) United States Patent
Dunne

(10) Patent No.: US 6,398,842 B2
(45) Date of Patent: Jun. 4, 2002

(54) APPARATUS FOR INJECTING SOLID PARTICULATE MATERIAL INTO A VESSEL

(75) Inventor: Martin Joseph Dunne, West Midland (AU)

(73) Assignee: Technological Resources Pty. Ltd., Melbourne (AU)

( * ) Notice: Subject to any disclaimer, the term of this patent is extended or adjusted under 35 U.S.C. 154(b) by 5 days.

(21) Appl. No.: 09/761,531

(22) Filed: Jan. 16, 2001

(30) Foreign Application Priority Data

Jan. 28, 2000 (AU) ..... PQ5328

(51) Int. Cl.[7] ..... C21C 5/32
(52) U.S. Cl. ..... 75/225
(58) Field of Search ..... 266/225

(56) References Cited

U.S. PATENT DOCUMENTS

| | | | | |
|---|---|---|---|---|
| 4,572,482 | A | 2/1986 | Bedell | |
| 5,443,572 | A | 8/1995 | Wilkinson et al. | |
| 5,498,277 | A | 3/1996 | Floyd et al. | |
| 6,245,285 | B1 * | 6/2001 | Dry | 266/226 |

FOREIGN PATENT DOCUMENTS

| | | |
|---|---|---|
| AU | B 22448/88 | 9/1988 |
| GB | 2 088 892 | 8/1981 |
| WO | WO 93/06251 | 4/1993 |
| WO | WO 96/31627 | 10/1996 |

OTHER PUBLICATIONS

Published International Application WO 00/14285 Sep. 2, 1999.

* cited by examiner

*Primary Examiner*—Melvyn Andrews
(74) *Attorney, Agent, or Firm*—Merchant & Gould, P.C.

(57) ABSTRACT

A metallurgical lance 27 for injecting solid particulate material into a smelting vessel comprising a central core tube 31 through which to deliver the solids material and an annular cooling jacket 32 surrounding the central core tube. Jacket 32 includes a long hollow annular structure 41 formed by outer and inner tubes 42, 43 interconnected by a front end connector 44. An elongate tubular structure 45 is disposed within the hollow annular structure 41 so to divide the interior of structure 41 into an inner annular water flow passage 46 and an outer annular water flow passage 47. Tubular structure 45 has a forward end piece 49 which fits within front end connector 44 of structure 41 to form an annular end flow passage 51 which interconnects the forward ends of water flow passage 46, 47. Cooling water flows forwardly down the lance through inner passage 46 then outwardly and back around the forward annular end passage 51 into the outer passage 47 through which it flows backwardly along the lance to an outlet 53. The effective cross-sectional area for water flow through end passage 51 is less than the cross-sectional flow area of both the inner and outer passages 46, 47 to produce a high water flow rate in the tip region of the cooling jacket.

12 Claims, 5 Drawing Sheets

APPARATUS FOR INJECTING SOLID PARTICULATE MATERIAL INTO A VESSEL

TECHNICAL FIELD

The present invention provides a metallurgical lance which extends into a vessel for injecting solid particulate material into a vessel. Apparatus of this kind may be used for injecting metallurgical feed material into the molten bath of a smelting vessel for producing molten metal, for example by a direct smelting process.

A known direct smelting process, which relies on a molten metal layer as a reaction medium, and is generally referred to as the HIsmelt process, is described in International application PCT/AU96/00197 (WO 96/31627) in the name of the applicant.

The HIsmelt process as described in the International application comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$, released from the bath in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. The lances must withstand operating temperatures of the order of 1400° C. within the smelting vessel. The lances must accordingly have an internal forced cooling system to operate successfully in this harsh environment and must be capable of withstanding substantial local temperature variations. The present invention enables the construction of lances which are able to operate effectively under these conditions.

DISCLOSURE OF THE INVENTION

According to the invention, there is provided a metallurgical lance to extend into a vessel for injecting solid particulate material into molten material held within the vessel, comprising:

a central core tube through which to pass the solid particulate material;

an annular cooling jacket surrounding the central core tube throughout a substantial part of its length, which jacket defines an inner elongate annular water flow passage disposed about the core tube, an outer elongate annular water flow passage disposed about the inner water flow passage, and an annular end passage interconnecting the inner and outer water flow passages at a forward end of the cooling jacket;

water inlet means for inlet of water into the inner annular water flow passage of the jacket at a rear end region of the jacket; and water outlet means for outlet of water from the outer annular water flow passage at the rear end region of the jacket, whereby to provide for flow of cooling water forwardly along the inner elongate annular passage to the forward end of the jacket then through the end flow passage means and backwardly through the outer elongate annular water flow passage, wherein the annular end passage curves smoothly outwardly and backwardly from the inner elongate annular passage to the outer elongate annular passage and the effective cross-sectional area for water flow through the end passage is less than the cross-sectional flow areas of both the inner and outer elongate annular water flow passages.

Preferably, the inner and outer elongate annular passages and the end passage of the jacket are defined by an inner tube and an outer tube interconnected at the forward end of the jacket by an annular end connector to form a single hollow annular structure which is closed at the forward end of the jacket by the annular end connector, and an elongate tubular structure disposed within the hollow annular structure and extending within it to divide the interior of the hollow annular structure into said inner and outer elongate annular passages to a forward end part disposed adjacent the annular end connector of said hollow annular structure such that the forward end passage is defined between said forward end part of the tubular structure and the annular end connector of said single hollow annular structure.

Preferably further, the forward end part of the tubular structure is connected to the annular end connector of said hollow annular structure to set the cross-sectional flow area of the forward end passage.

Preferably further, said single hollow annular structure is mounted so as to permit relative longitudinal movement between the inner and outer tubes thereof due to differential thermal expansion or contraction thereof and the elongate tubular structure is mounted to accommodate that movement.

More specifically, it is preferred that the outer tube of the single hollow annular structure be provided with a fixed mounting means and the inner tube of that structure be supported in sliding mounting means to enable the inner tube to move axially to accommodate differential thermal expansion and contraction and the rear end of the inner tubular structure is supported in a second sliding mounting to permit the inner tubular structure to move with the inner tube of said hollow annular structure.

The inner tubular structure may be directly connected to the inner tube of the hollow annular structure to move axially with it. Such connection may be provided by a series of circumferentially spaced connectors at the rearward end of the inner tubular structure.

BRIEF DESCRIPTION OF THE DRAWINGS

In order that the invention may be more fully explained, one particular embodiment will be described with reference to the accompanying drawings in which.

DETAILED DESCRIPTION OF THE PREFERRED EMBODIMENT

Figure 1:
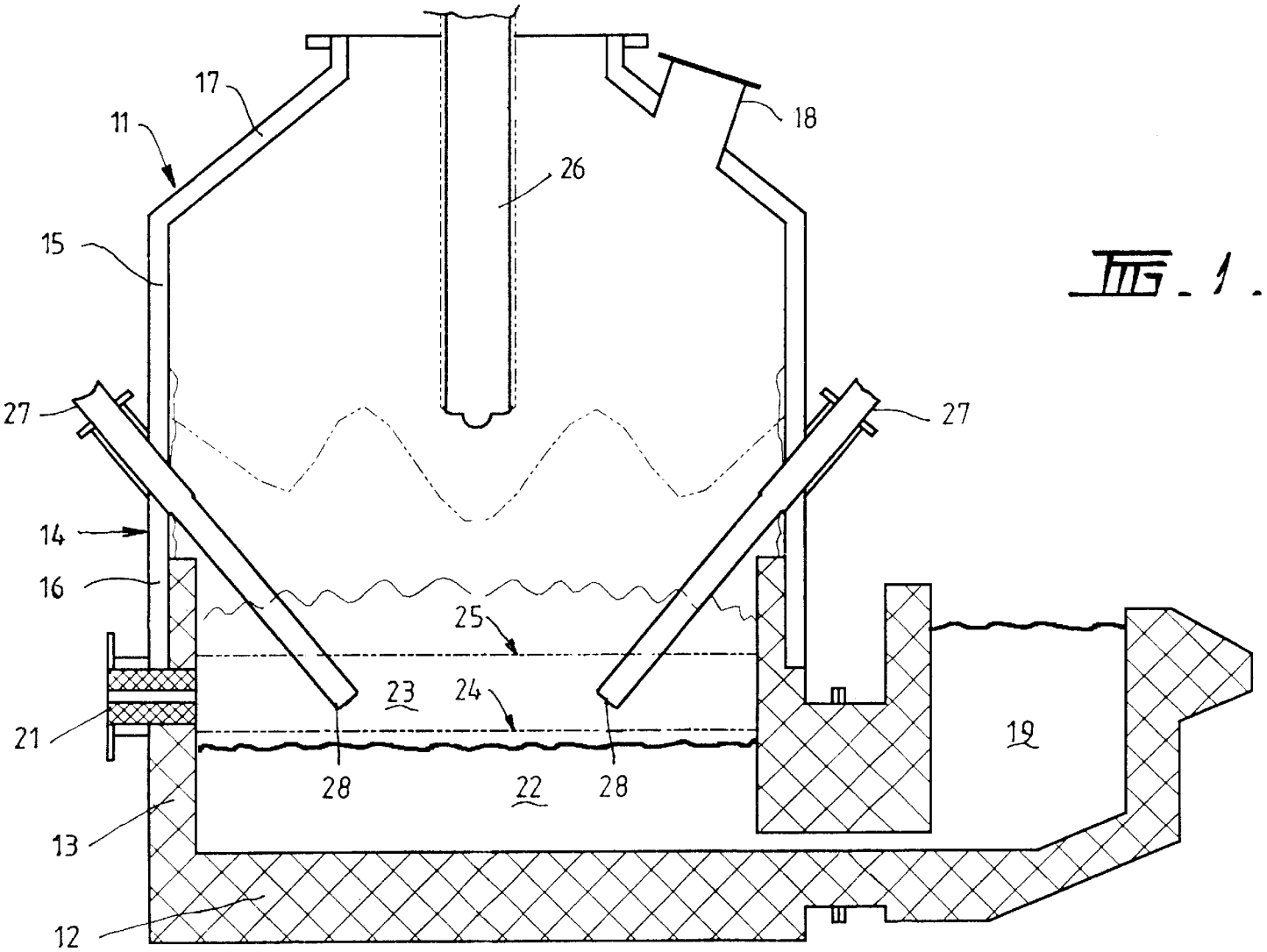
FIG. 1 is a vertical section through a metallurgical vessel incorporating a pair of solids injection lances constructed in accordance with the invention.
Figure 2A:
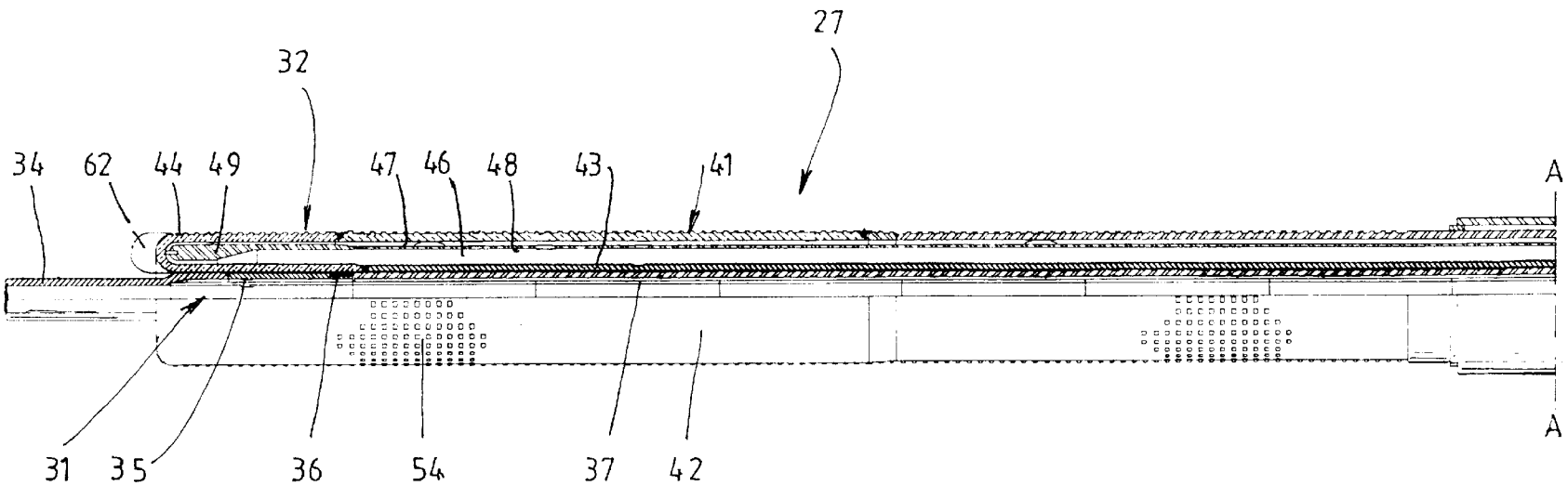
FIGS. 2A and 2B join on the line A—A to form a longitudinal cross-section through one of the solids injection lances.
Figure 2B:
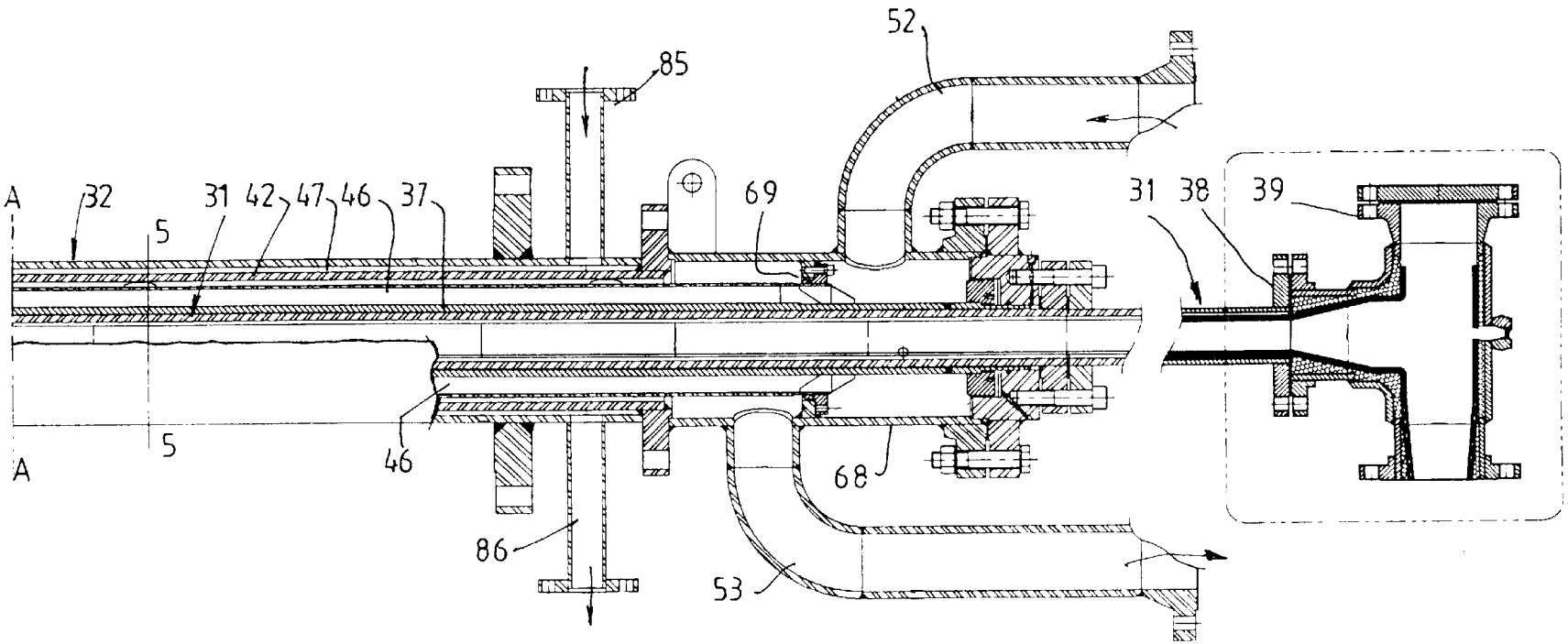
Figure 3:
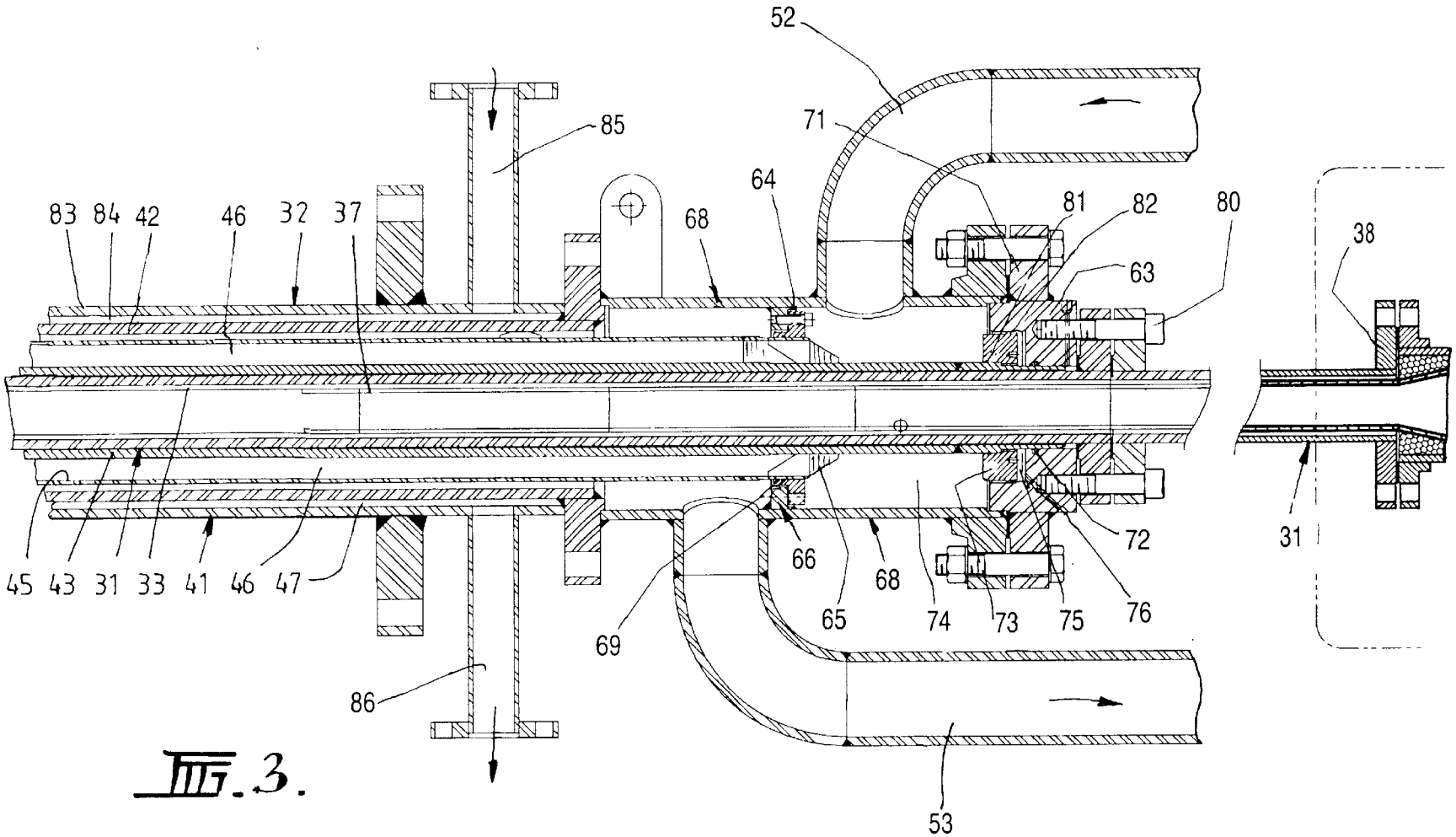
FIG. 3 is an enlarged longitudinal cross-section through a rear end of the lance.
Figure 4:
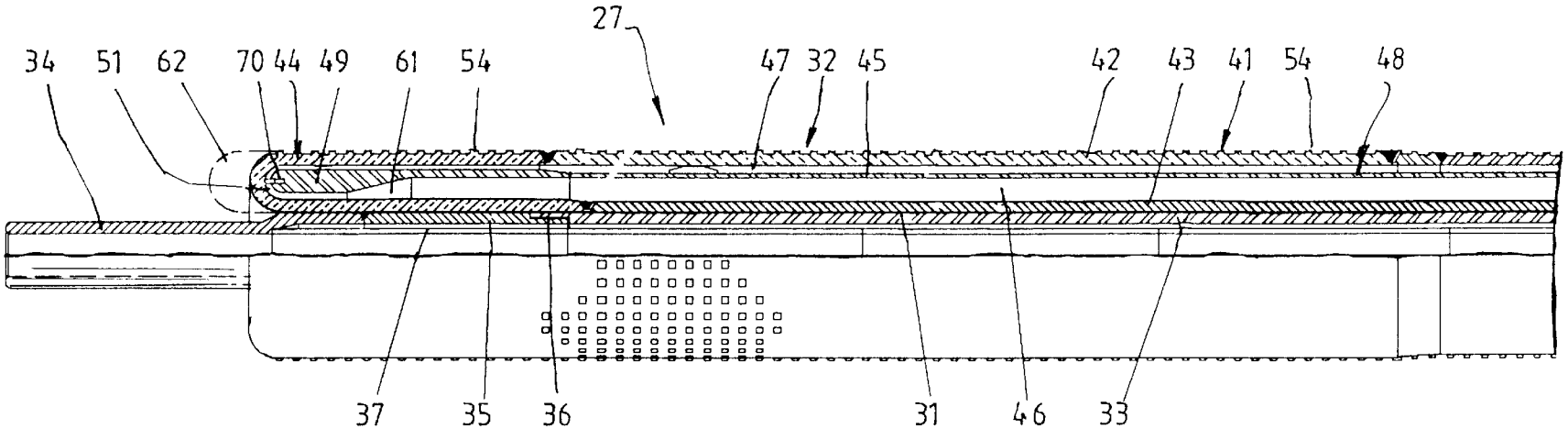
FIG. 4 is an enlarged cross-section through the forward end of the lance.
Figure 5:
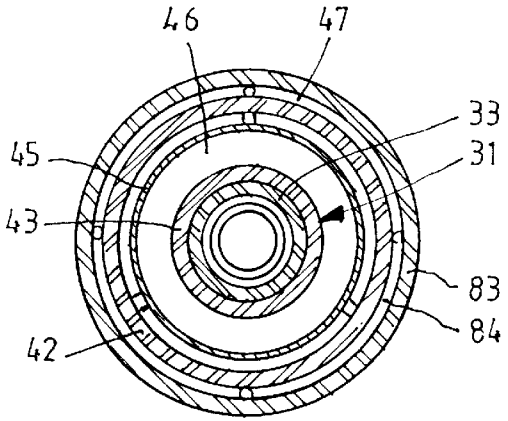
FIG. 5 is a transverse cross-section on the line 5—5 in FIG. 4.

FIG. 1 illustrates a direct smelting vessel suitable for operation by the HIsmelt process as described in International Patent Application PCT/AU96/00197. The metallurgical vessel is denoted generally as 11 and has a hearth that incudes a base 12 and sides 13 formed from refractory bricks; side walls 14 which form a generally cylindrical barrel extending upwardly from the sides 13 of the hearth and which incudes an upper barrel section 15 and a lower barrel section 16; a roof 17; an outlet 18 for off-gases; a forehearth 19 for discharging molten metal continuously; and a tap-hole 21 for discharging molten slag.

In use, the vessel contains a molten bath of iron and slag which includes a layer 22 of molten metal and a layer 23 of molten slag on the metal layer 22. The arrow marked by the numeral 24 indicates the position of the nominal quiescent surface of the metal layer 22 and the arrow marked by the numeral 25 indicates the position of the nominal quiescent surface of the slag layer 23. The term "quiescent surface" is understood to mean the surface when there is no injection of gas and solids into the vessel.

The vessel is fitted with a downwardly extending hot air injection lance 26 for delivering a hot air blast into an upper region of the vessel and two solids injection lances 27 extending downwardly and inwardly through the side walls 14 and into the slag layer 23 for injecting iron ore, solid carbonaceous material, and fluxes entrained in an oxygen-deficient carrier gas into the metal layer 22. The position of the lances 27 is selected so that their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel.

The construction of the solids injection lances is illustrated in FIGS. 2 to 5. As shown in these figures, each lance 27 comprises a central core tube 31 through which to deliver the solids material and an annular cooling jacket 32 surrounding the central core tube 31 throughout a substantial part of its length. Central core tube 31 is formed of carbon/alloy steel tubing 33 throughout most of its length, but a stainless steel section 34 at its forward end projects as a nozzle from the forward end of cooling jacket 32. The forward end part 34 of core tube 31 is connected to the carbon/alloy steel section 33 of the core tube through a short steel adaptor section 35 which is welded to the stainless steel section 34 and connected to the carbon/alloy steel section through a screw thread 36.

Central core tube 31 is internally lined through to the forward end part 34 with a thin ceramic lining 37 formed by a series of cast ceramic tubes. The rear end of the central core tube 31 is connected through a coupling 38 to a T-piece 39 through which particulate solids material is delivered in a pressurised fluidising gas carrier, for example nitrogen.

Annular cooling jacket 32 comprises a long hollow annular structure 41 comprised of outer and inner tubes 42, 43 interconnected by a front end connector piece 44 and an elongate tubular structure 45 which is disposed within the hollow annular structure 41 so as to divide the interior of structure 41 into an inner elongate annular water flow passage 46 and an outer elongate annular water flow passage 47. Elongate tubular structure 45 is formed by a long carbon steel tube 48 welded to a machined carbon steel forward end piece 49 which fits within the front end connector 44 of the hollow tubular structure 41 to form an annular end flow passage 51 which interconnects the forward ends of the inner and outer water flow passages 46, 47.

The rear end of annular cooling jacket 32 is provided with a water inlet 52 through which the flow of cooling water can be directed into the inner annular water flow passage 46 and a water outlet 53 from which water is extracted from the outer annular passage 47 at the rear end of the lance. Accordingly, in use of the lance cooling water flows forwardly down the lance through the inner annular water flow passage 46 then outwardly and back around the forward annular end passage 51 into the outer annular passage 47 through which it flows backwardly along the lance and out through the outlet 53. This ensures that the coolest water is in heat transfer relationship with the incoming solids material to ensure that this material does not melt or burn before it discharges from the forward end of the lance and enables effective cooling of both the solids material being injected through the central core of the lance as well as effective cooling of the forward end and outer surfaces of the lance.

The outer surfaces of the tube 42 and front end piece 44 of the hollow annular structure 41 are machined with a regular pattern of rectangular projecting bosses 54 each having an undercut or dove tail cross-section so that the bosses are of outwardly diverging formation and serve as keying formations for solidification of slag on the outer surfaces of the lance. Solidification of slag on to the lance assists in minimising the temperatures in the metal components of the lance. It has been found in use that slag freezing on the forward or tip end of the lance serves as a base for formation of an extended pipe of solid material serving as an extension of the lance which further protects exposure of the metal components of the lance to the severe operating conditions within the vessel.

It has been found that it is very important to cooling of the tip end of the lance to maintain a high water flow velocity around the annular end flow passage 51. In particular it is most desirable to maintain a water flow velocity in this region of the order of 10 meters per second to obtain maximum heat transfer. In order to maximise the water flow rate in this region, the effective cross-section for water flow through passage 51 is significantly reduced below the effective cross-section of both the inner annular water flow passage 46 and the outer water flow passage 47. Forward end piece 49 of the inner tubular structure 45 is shaped and positioned so that water flowing from the forward end of inner annular passage 46 passes through an inwardly reducing or tapered nozzle flow passage section 61 to minimise eddies and losses before passing into the end flow passage 51. The end flow passage 51 also reduces in effective flow area in the direction of water flow so as to maintain the increased water flow velocity around the bend in the passage and back to the outer annular water flow passage 47. In this manner, it is possible to achieve the necessary high water flow rates in the tip region of the cooling jacket without excessive pressure drops and the risk of blockages in other parts of the lance.

In order to maintain the appropriate cooling water velocity around the tip end passage 51 and to minimise heat transfer fluctuations, it is critically important to maintain a constant controlled spacing between the front end piece 49 tubular structure 45 and the end piece 44 of the hollow annular structure 41. This presents a problem due to differential thermal expansion and contraction in the components of the lance. In particular, the outer tube part 42 of hollow annular structure 41 is exposed to much higher temperatures than the inner tube part 43 of that structure and the forward end of that structure therefore tends to roll forwardly in the manner indicated by the dotted line 62 in FIG. 4. This produces a tendency for the gap between components 44, 49 defining the passage 51 to open when the lance is exposed to the operating conditions within the smelting vessel. Conversely, the passage can tend to close if there is a drop in temperature during operation. In order to overcome this problem the rear end of the inner tube 43 of hollow annular structure 41 is supported in a sliding mounting 63 so that it can move axially relative to the outer tube 42 of that structure, the rear end of inner tubular structure 45 is also mounted in a sliding mounting 64 and is connected to the inner tube 43 of structure 41 by a series of circumferentially spaced connector cleats 65 so that the tubes 43 and 45 can move axially together. In addition, the end pieces 44, 49 of the hollow annular structure 41 and tubular structure 45 are positively interconnected by a series of circumferentially spaced dowels 70 to maintain the appropriate spacing under both thermal expansion and contraction movements of the lance jacket.

The sliding mounting 64 for the inner end of tubular structure 45 is provided by a ring 66 attached to a water flow manifold structure 68 which defines the water inlet 52 and outlet 53 and is sealed by an O-ring seal 69. The sliding mounting 63 for the rear end of the inner tube 43 of structure 41 is similarly provided by a ring flange 71 fastened to the water manifold structure 68 and is sealed by an O-ring seal 72. An annular piston 73 is located within ring flange 71 and connected by a screw thread connection 80 to the back end of the inner tube 43 of structure 41 so as to close a water inlet manifold chamber 74 which receives the incoming flow of cooling from inlet 52. Piston 73 slides within hardened surfaces on ring flange 71 and is fitted with O-rings 81, 82. The sliding seal provided by piston 73 not only allows movements of the inner tube 43 due to differential thermal expansion of structure 41 but it also allows movement of tube 43 to accommodate any movement of structure 41 generated by excessive water pressure in the cooling jacket. If for any reason the pressure of the cooling water flow becomes excessive, the outer tube of structure 41 will be forced outwardly and piston 73 allows the inner tube to move accordingly to relieve the pressure build up. An interior space 75 between the piston 73 and the ring flange 71 is vented through a vent hole 76 to allow movement of the piston and escape of water leaking past the piston.

The rear part of annular cooling jacket 32 is provided with an outer stiffening pipe 83 part way down the lance and defining an annular cooling water passage 84 through which a separate flow of cooling water is passed via a water inlet 85 and water outlet 86.

Typically cooling water will be passed through the cooling jacket at a flow rate of 100 $m^3$/Hr at a maximum operating pressure of 800 kPa to produce water flow velocities of 10 meters/minute in the tip region of the jacket. The inner and outer parts of the cooling jacket can be subjected to temperature differentials of the order of 200° C. and the movement of tubes 42 and 45 within the sliding mountings 63, 64 can be considerable during operation of the lance, but the effective cross-sectional flow area of the end passage 51 is maintained substantially constant throughout all operating conditions.

Although the illustrated lance has been designed for injection of solids into a direct reduction smelting vessel, it will be appreciated that similar lances may be used for introducing solid particulate material into any metallurgical vessel or induced any vessel in which high temperature conditions prevail. It is accordingly to be understood that this invention is in no way limited to the details of the illustrated construction and that many modifications and variations will fall within the scope of the appended claims.

What is claimed is:

1. A metallurgical lance to extend into a vessel for injecting solid particulate material into molten material held within the vessel, comprising:

a central core tube through which to pass the solid particulate material;

an annular cooling jacket surrounding the central core tube throughout a substantial part of its length, which jacket defines an inner elongate annular water flow passage disposed about the core tube, an outer elongate annular water flow passage disposed about the inner water flow passage, and an annular end passage interconnecting the inner and outer water flow passages at a forward end of the cooling jacket;

water inlet means for inlet of water into the inner annular water flow passage of the jacket at a rear end region of the jacket; and water outlet means for outlet of water from the outer annular water flow passage at the rear end region of the jacket, whereby to provide for flow of cooling water forwardly along the inner elongate annular passage to the forward end of the jacket then through the end flow passage means and backwardly through the outer elongate annular water flow passage, wherein the annular end passage curves smoothly outwardly and backwardly from the inner elongate annular passage to the outer elongate annular passage and the effective cross-sectional area for water flow through the end passage is less than the cross-sectional flow areas of both the inner and outer elongate annular water flow passages.

2. A metallurgical lance as claimed in claim 1, wherein the inner and outer elongate annular passages and the end passage of the jacket are defined by an inner tube and an outer tube interconnected at the forward end of the jacket by an annular end connector to form a single hollow annular structure which is closed at the forward end of the jacket by the annular end connector, and an elongate tubular structure disposed within the hollow annular structure and extending within it to divide the interior of the hollow annular structure into said inner and outer elongate annular passages to a forward end part disposed adjacent the annular end connector of said hollow annular structure such that the forward end passage is defined between said forward end part of the tubular structure and the annular end connector of said single hollow annular structure.

3. A metallurgical lance as claimed in claim 2, wherein the forward end part of the tubular structure and the annular end connector of said hollow annular structure are positively spaced apart by spacer means extending between them to set the cross-sectional flow area of the forward end passage.

4. A metallurgical lance as claimed in claim 2, wherein said single hollow annular structure is mounted so as to permit relative longitudinal movement between the inner and outer tubes thereof due to differential thermal expansion or contraction thereof and the elongate tubular structure is mounted to accommodate that movement.

5. A metallurgical lance as claimed in claim 4, wherein the outer tube of the single hollow annular structure is provided with a fixed mounting means and the inner tube of that structure is supported in sliding mounting means to enable the inner tube to move axially to accommodate differential thermal expansion and contraction and the rear end of the inner tubular structure is supported in a second sliding mounting to permit the inner tubular structure to move with the inner tube of said hollow annular structure.

6. A metallurgical lance as claimed in claim 5, wherein the inner tubular structure is directly connected to the inner tube of the hollow annular structure to move axially with it.

7. A metallurgical lance as claimed in claim 6, wherein the connection between the inner tubular structure and the inner tube of the hollow annular structure is provided by a series of circumferentially spaced connectors at the rearward end of the inner tubular structure.

8. A metallurgical lance as claimed in claim 4, wherein the sliding mounting means for the inner tube of the hollow annular structure comprises a mounting ring attached to a water flow manifold structure defining said water inlet and outlet means.

9. A metallurgical lance as claimed in claim 8, wherein the second sliding mounting supporting the rear end of the inner tubular structure comprises a second ring attached to the water flow manifold.

10. A metallurgical lance as claimed in claim 9, wherein a water inlet chamber is defined within the manifold structure between the two sliding mounting rings.

11. A metallurgical lance as claimed in claim 10, wherein an annular piston is disposed within the water inlet chamber and fixed to the rear end of the inner tube of the hollow annular structure to allow movement of that inner tube to accommodate excessive water pressure in the cooling jacket.

12. A metallurgical lance as claimed in claim 1, wherein the outer surface of the annular cooling jacket is formed with regular pattern projecting bosses of outwardly diverging formation so as to serve as keying formations for solidification of slag on the outer surfaces of the lance.

* * * * *